US005477941A

United States Patent [19]

Kumar et al.

[11] Patent Number: 5,477,941

[45] Date of Patent: Dec. 26, 1995

[54] ON-BOARD LUBRICATION SYSTEM FOR DIRECT APPLICATION TO CURVED AND TANGENT RAILROAD TRACK

[75] Inventors: Sudhir Kumar, Darien, Ill.; Shiv R. Kumar, Vienna, Va.

[73] Assignee: Tranergy Corporation, Darien, Ill.

[21] Appl. No.: 212,768

[22] Filed: Mar. 15, 1994

[51] Int. Cl.[6] ..... B61K 3/00

[52] U.S. Cl. ..... 184/3.2; 188/3 R; 184/6

[58] Field of Search ..... 184/3.1, 3.2, 6; 104/279; 198/500; 188/3 R

[56] References Cited

U.S. PATENT DOCUMENTS

| | | | |
|---|---|---|---|
| 1,386,426 | 8/1921 | Riddle | 184/3.2 |
| 1,709,095 | 4/1929 | Protzeller | 184/3.2 |
| 4,930,600 | 6/1990 | Kumar et al. | 184/3.2 |

FOREIGN PATENT DOCUMENTS

| | | | |
|---|---|---|---|
| 60736 | 1/1955 | France | 184/3.2 |
| 4146871 | 5/1992 | Japan | 184/3.2 |
| 724189 | 2/1955 | United Kingdom | 184/3.1 |

*Primary Examiner*—Thomas E. Denion

*Attorney, Agent, or Firm*—Dorn, McEachran, Jambor & Keating

[57] ABSTRACT

In railroad applications, an improved method and apparatus for optimizing on-board rail lubrication for both curved and tangent track. The lubricants are applied by an apparatus directly to the rails behind the last axle of the last locomotive of a locomotive consist. The system uses lubricant delivery nozzles which are integrated with the sand pipe and nozzle for each rail. The lubricant nozzles are aimed toward the wheel rail contact at a distance of several inches behind the contact for accurate application of one lubricant on the top of the rail (TOR) and another on the rail gage side (RAGS). The lubricant quantities sprayed on the rail are controlled by a miroprocessor with the use of a flow injection pulse, system or flow control valves. Furthermore, the microprocessor triggers sand application when emergency brakes are applied. A new method of determination of trailing tons in the train is used by averaging the total power used by the locomotives at a certain speed.

14 Claims, 8 Drawing Sheets

INPUT AND CONTROL LOGIC FOR THE LUBRICATION SYSTEM

INPUTS TO THE MICROPROCESSOR

* Speed
* Rail Curve
* Rain
* Temperature
* Braking
* Emergency Braking
* Going in Reverse Direction

CONTROL

* Lubricant flow controlled by fluid injection pulses or variable flow control valve (by Computer) AND/OR lubricant pumps (also controlled by Computer)
* Rates of application or spray of the two lubricants (by Computer)

SHUT OFF LUBRICANT APPLICATION WHEN:

* Brakes are applied
* Raining
* Train is going in opposite direction
* Lubrication chambers are empty
* Manual override is initiated
* Some contingency develops

TURN ON

* Turn on lubrication system at the other end of locomotive when train is going in opposite direction
* Sand application when emergency brakes are applied.

FIGURE 8

ON-BOARD LUBRICATION SYSTEM FOR DIRECT APPLICATION TO CURVED AND TANGENT RAILROAD TRACK

BACKGROUND OF THE INVENTION

In U.S. Pat. No. 4,930,600 Kumar and Kumar have presented the background of the existing state of the art in rail lubrication systems. Those comments still apply. None of the lubricators available prior to the U.S. Pat. No. 4,930,600, including both on-board and wayside lubricators, adequately met the demands of both tangent and curved track. Prior lubricators did not apply the lubricant correctly and effectively on tangent track. They also did not control and change the amount of lubricant depending on the tonnage being hauled, angle of attack of the wheel on the rail, and environmental conditions such as rain and temperature. Prior lubricators were not aimed at reducing the force with which the flange contacts with the rail. The system patented by Kumar and Kumar in U.S. Pat. No. 4,930,600 overcame these problems and provided the intelligent controls for the application of both the Top Of the Rail (TOR) which is a consumable lubricant and the Rail Gage Side (RAGS) which is a long life lubricant. The lubricants used for TOR and RAGS awe preferably bio-degradable for environmental benefits. The present invention is an extension of the development in the U.S. Pat. No. 4,930,600 patent.

SUMMARY OF THE INVENTION

The ideal lubricator should be able to achieve correct levels of lubrication efficiently on both tangent and curved track. It should reduce the wheel flange force on the rail as well as its friction coefficient. To accomplish this will require the application of separate lubricants of different characteristics to the rail crown and gage side. The rate of lubrication should be controlled by the train speed, the wheel angle of attack, the trailing tons of the train, braking, ambient temperature, rain or other environmental factors, and the physical/chemical properties of the lubricant. The lubricants should be applied in such a way that it results in minimum environmental pollution without loss of traction of the locomotive or other tractive wheels. Ideally, both lubricants should be applied after the passage of the tractive wheels, and the rail crown lubrication should be applied in small enough quantities that it is consumed by the passage of the train applying it. Too much lubricant is bad because it leads to undetected internal rail fatigue and crack growth, resulting in sudden lateral fracture of the rail and catastrophic accidents. Too much lubricant is also environmentally undesirable. The present invention achieves all of the above objectives through improved design, measurement of relevant parameters, input of the needed parameters from the train operations recorder/locomotive computer and control through a microprocessor system.

More particularly, this invention is an improved intelligent on-board rail-wheel lubrication system which works effectively on both tangent and curved track. The system uses two separate lubricant tubes and nozzles which are integrated at the delivery end with the sand pipe and nozzle for each rail. The lubricant nozzles are placed near each rail and aimed accurately towards the wheel-rail contact (several inches behind it) of the trailing wheel set of the last locomotive in the locomotive consist. One of the lubricants which is consumable is sprayed on the top of the rail and another which is long-lasting is sprayed on the gage side of each rail. The amounts of the two lubricants applied are controlled by a microprocessor and a number of operational parameters. These parameters include speed, trailing tons, degree of rail curve, temperature, rain, braking, and train direction.

The system of the present invention measures the degree of the curve by use of a displacement sensor mounted on the truck and connected to the car body. The new system also applies the two lubricants directly to the rail while aiming them radially toward the wheel rail contact. This method enables direct lubricant application to the rail. The invention further includes the integration of the sand application nozzle with the lubricant application nozzle and support. This will result in lubrication nozzles and their direction remaining firmly in the correct position thus reducing maintenance. The present invention also includes the use of either flow control valves or flow injection pulse system. It includes logic for lubrication shut off when any type of brakes (dynamic, independent, automatic, or emergency). It also includes a provision for triggering the application of sand when emergency brakes are applied. It includes provision for the change of direction of train travel and application of lubricant at the other end of the locomotive through the use of computer controlled flow control valves. This invention further includes an approach to determination of trailing tons in the train by using an averaging method of power used by the locomotives. This invention further utilizes the output of the locomotive computer provided to the train operations recorder for speed, trailing tons, brake application, emergency braking, and direction of travel.

The lubricant used for TOR is preferably bio-degradable consisting of primarily organic materials. It is liquid lubricant which does not leave any residue on the rail surface after it is consumed. This invention further utilizes a bio-degradable long-lasting lubricant for the gage side of the rail which is chemically compatible with TOR, so that the two lubricants (TOR and RAGS) do not harmfully react with each other in areas of overlap of the TOR and RAGS sprays.

The rate of application of TOR, controlled by the microprocessor, is just enough so that it is consumed by the wheels of the whole train when the train has passed. No lubricating residue is left on the rail crown after the train passage so that adhesion of the locomotive wheels of the next train is not negatively affected. The flange lubricant (RAGS) is, however, long-lasting and will continue to lubricate the flanges of the locomotive and car wheels of the next train coming on those tracks.

BRIEF DESCRIPTION OF THE DRAWINGS

FIG. 8 summarizes, in tabular form, the input and control logic for the system.

DETAILED DESCRIPTION OF THE INVENTION

In a train having all the locomotives located at the front end, the present invention is intended to be mounted on the last locomotive behind its last tractive wheel set. If the train is very long, and two or more sets of locomotives are located at several positions, this invention is intended to be mounted on the last locomotive of each set of locomotives. To allow the locomotive to be driven in either direction in a consist, this device may be installed on both trucks and only the unit behind the last tractive wheel on the rear truck will be turned on.

Figure 1:
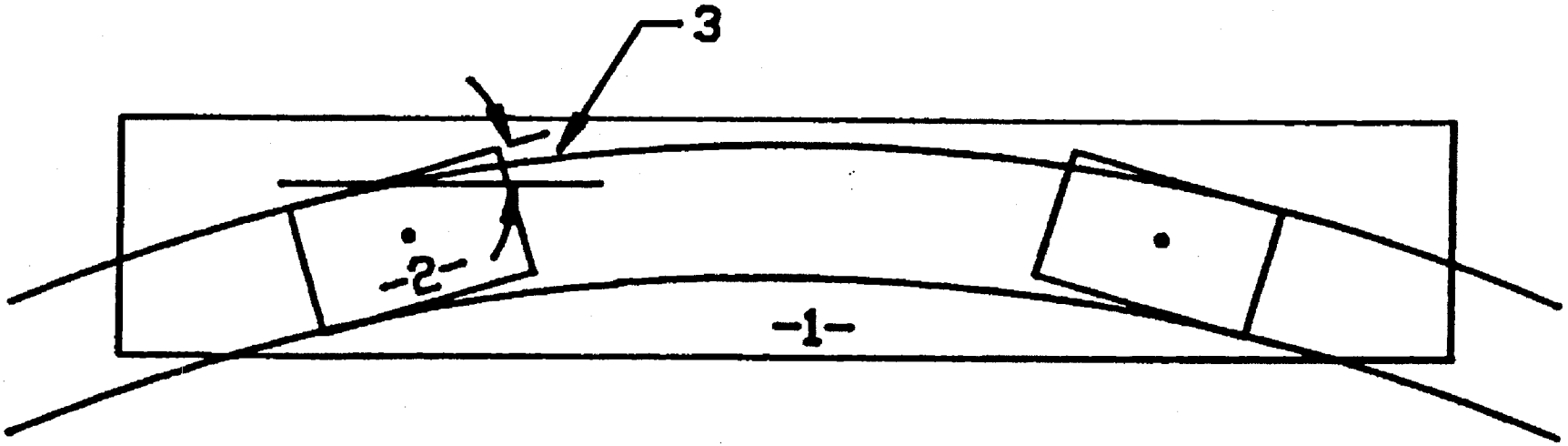
FIG. 1 is a schematic plan view of the last locomotive of the locomotive consist of a train showing the locomotive car body, the trailing truck, and the angle $\delta$ that the truck side frame makes with the locomotive car body side.

FIG. 1 schematically shows the last locomotive car body 1 with its rear truck 2 on curved track in a plan view. The direction of motion is to the right as viewed in the drawing. The angle 3 that the truck side frame makes with the car body side is shown as δ. As shown by Kumar and Kumar in U.S Pat. No. 4,930,600, the angle δ is proportional to the degree of the curve of the rail that the locomotive is negotiating.

Figure 2:
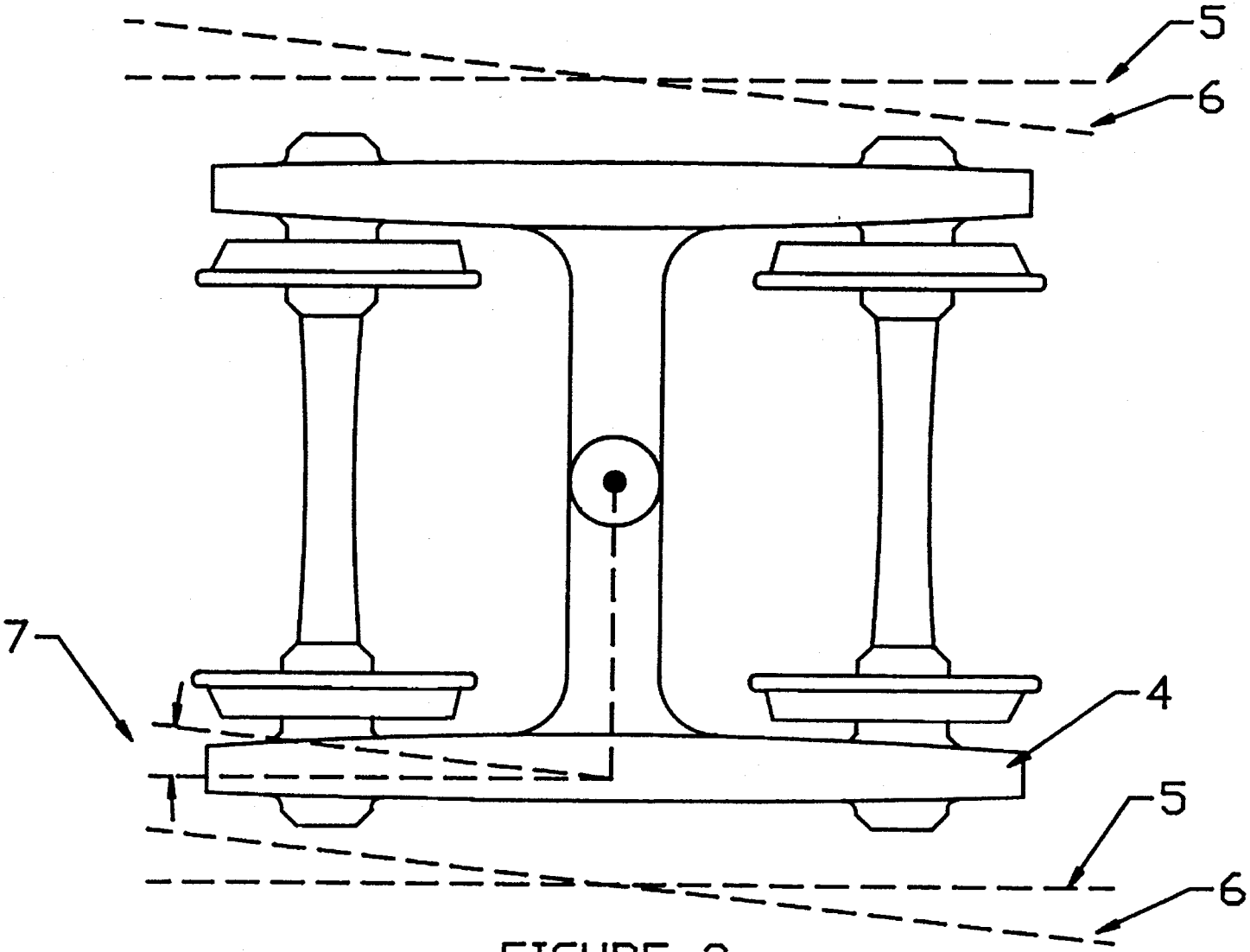
FIG. 2 is a plan view of the locomotive truck and the angle $\delta$ its side frame makes with the car body side.

FIG. 2 shows the angle δ in a little more detail at 7. FIG. 2 also shows the truck side frame 4, the car body side positions on tangent track at 5 and the car body side positions on curved track at 6. Angle δ is an important measure for the amount of lubricants to be applied to the rail for optimum effectiveness. The amount of lubricant to be applied to the rail should be enough to handle negotiation of curved track, but should be as small as possible so that no TOR (Top of the Rail Lubricant) is left on the rail head after the train has passed. It will also be beneficial from the environmental point of view. Excess lubricant application is a serious hazard for railroad personnel on track and in tunnels. Excess accumulation of lubricants on the under body of the locomotive car body and trucks has been known to be a fire hazard.

Figure 3:
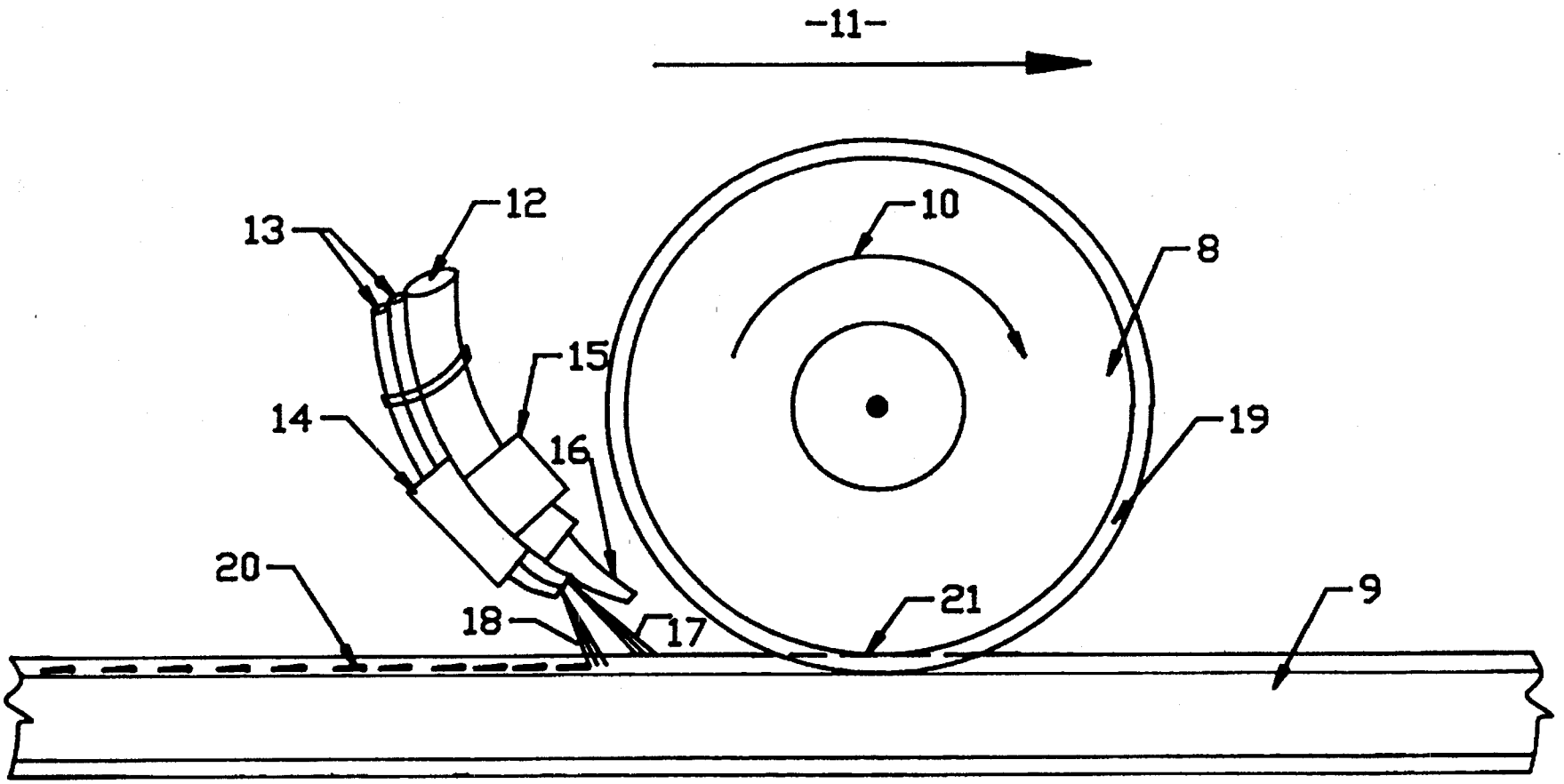
FIG. 3 is a side elevation view showing one of the wheels of the last wheel set of the rear locomotive of the locomotive consist along with the lubrication tubes and lubrication nozzle housing assembly which are integrated with the sanding pipe and sanding nozzle.

FIG. 3 shows a schematic arrangement of the placement of the lubrication application/spray assembly 14 mounted on the rear truck of the last locomotive in the locomotive consist. The diagram shows the rear axle wheel 8 riding on the rail 9 as seen from the inside of the truck. The flange 19 of the wheel 8 rubs the rail 9 on its inside called the rail gage side. The wheel rotation direction is shown by arrow 10 and the direction of train travel is shown by arrow 11.

When there is a small angle δ between the locomotive truck side frame and the locomotive car body and the flange 19 is rubbing against the rail gage side, there is a large lateral friction force developing between the top of the rail and the wheel tread. Application of TOR reduces this friction. It simultaneously reduces the force with which the wheel flange presses against the rail. The present invention applies a consumable TOR lubricant 17 on top of the rail and a RAGS lubricant 18 on the gage side of the rail after the passage of the last wheel set of the last locomotive thus reducing the friction between the wheels of the trailing cars and the rails. The TOR is just enough that it is consumed by the time the train has passed and the locomotives of the next train experience no loss of adhesion. The RAGS being a long-lasting lubricant, however, stays on the gage side of the rail, leaving enough lubricity that it helps to reduce the friction of the flanges of the locomotive wheels of the next train thus eliminating the need of present wheel flange lubricators on the locomotives. This is desirable So the locomotive can develop and maintain the high levels of adhesion desired today.

Modern locomotives are generally equipped with a sand applicator pipe 12 and nozzle 16 which are held in place by a bracket 15 attached to the truck axle box. The present invention integrates the lubrication application tubes 13 and the application/spray assembly 14 with the sand application pipe 12, support bracket 15 and the nozzle 16. It is important to apply the lubricant spray accurately on the top of the rail and on its gage side in order to get maximum benefit. On curves, the locomotive car body exhibits lateral movement with respect to the rail and even with respect to the truck due to the angle δ. As a result, the point of application of the lubricant sprays 17,18 tends to change position on the rail head. This movement is minimal at or near the point of contact 21 of the wheel and rail. The present invention uses lubricant sprays 17,18 aimed towards the wheel rail contact 21 but having the lubricant hit the rail at a small distance (several inches) from the contact 21 so that the lubricant application is on the rail trailing behind contact point 21 but never reaching the contact 21. This is important so that the traction of the locomotive wheel is never reduced; only the friction between the trailing car wheels and the rail is reduced. As the train moves forward, a bead or spray of the lubricant will trail on the rail due to the sprays 17,18. Spray on the rail gage side 18 can be seen leaving the lubricant line 20 on the rail gage side in FIG. 3.

Figure 4:
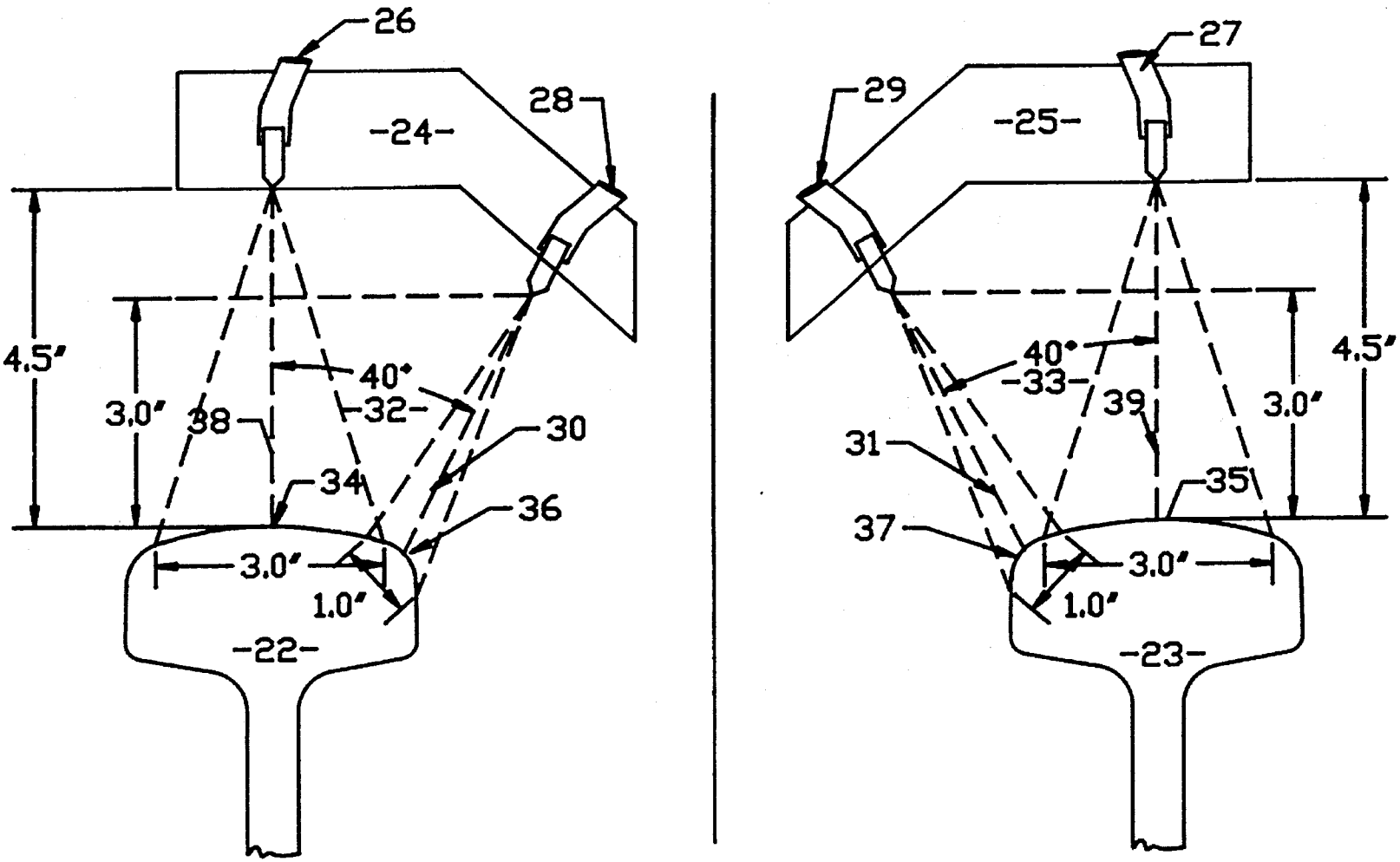
FIG. 4 is a front elevation view of the gage side and top of the rail lubricant sprays on both the left and right rails, and the regions of the rail covered by each lubricant.

FIG. 4 shows a front view of the application of TOR and RAGS lubricants on the left 22 and right 23 rails. The is applied through a support system 24,25 and the use of nozzles 26,27 from a height between 2 to 12 inches. The TOR is aimed at a point 34,35 of the center of the rail head slightly towards the gage side. The spray width can be from a very narrow width to a very large width (0 to 6 inches) depending upon the condition,of the track, trucks, type of spray nozzle, wind speed, and the type of lubricant. The 3-inch spray width of TOR shown in FIG. 4 is for illustrative purposes only.

The RAGS lubricant is applied through tubes and nozzles 28,29 from the side of the rail gage and from a height anywhere between 2 to 12 inches. The nozzle height is shown nominally in FIG. 4 as 3 inches. The gage lubricant should be aimed approximately at the gage corner of each rail. In order to cover the gage corner uniformly, it should be aimed at an angle 32,33, with the vertical shown nominally in the diagram as 40 degrees. The width of the gage lubricant spray 30,31 at the rail gage corner can be from 0.1 to 3.0 inches. The width shown in FIG. 4 is nominally 1 inch. The two lubricant nozzles are positioned with the help of the lubricant nozzle spray assembly 14 which is integrated with the sand application bracket 15 and nozzle 16 (FIG. 3). The support brackets 24,25 shown schematically in FIG. 4 are integrated with spray assembly 14 in the final assembly. Thus, the TOR spray 17 side view is seen as spray 38,39 in the front view as shown in FIG. 4. Similarly, RAGS spray 18 side view is seen as 30,31 in the front view as shown in FIG. 4.

Figure 5:
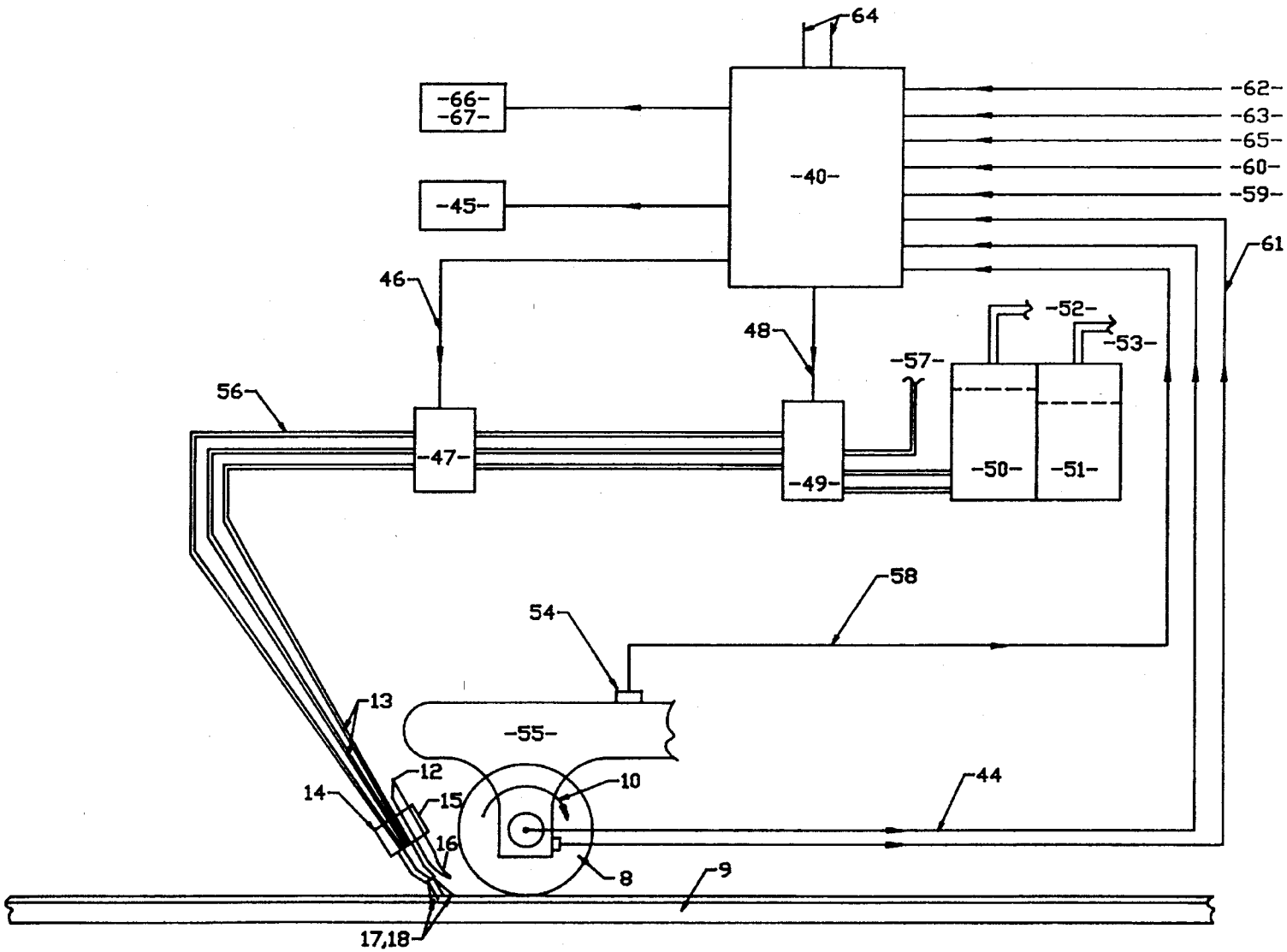
FIG. 5 is a schematic circuit diagram of the microprocessor controller for the application of the lubricants on the rail head.

FIG. 5 shows the microprocessor 40 based controller system for the application of TOR and RAGS lubricant sprays 17,18 directly on the rail 9. The microprocessor receives eight inputs 62,63,65,60,59,61,44,58. The power supply to the microprocessor is shown at 64. The amount of each of the two lubricants applied to the rail is controlled by the eight inputs.

The application of brakes, including dynamic, independent or automatic, is received as a signal in line 62. The microprocessor will stop the application of lubricants upon receiving such a signal.

The emergency brake application, line 63, will signal the microprocessor to stop lubricant application and signal the locomotive computer to begin sanding.

Input 65 to the microprocessor is regarding the direction of travel of the train. If the direction of travel changes, this signal will be used for shutting off the lubricant application system at one end of the locomotive and turning on the system at the other end.

Input 60 is an input from a rain and snow sensor suitably mounted externally on the locomotive. When water, snow, or ice are present on the rail, the lubrication system is turned off since the water acts as a partial lubricant.

Input 59 provides the microprocessor the information on trailing tons in the train. This input may provided manually by the locomotive engineer or obtained from the locomotive computer. If neither approach is suitable, a computation based on the averaging of power with a certain default value as a starting value is used for computation in the lubrication system. The default value may be based on the power used for the average train on that system.

Input 61 provides the microprocessor temperature reading of the ambient atmosphere. This value will be used as one of the parameters to control the quantity of lubricant best suited for a given temperature. The temperature sensor shown in FIG. 5 is attached to the axle box. However, it can be placed anywhere else at a suitable and safe position outside of the locomotive.

Input 44 provides the reading of the train speed to the microprocessor. This reading may be taken from the locomotive wheel axle rotational speed as shown in FIG. 5. However, it will be simpler to take it from the output of the locomotive computer.

The final input 58 provides a value of the sharpness of the rail curve. This reading is obtained by a displacement sensor 54 such as an LVDT (linear variable displacement transducer) mounted on the truck side frame 55 at one end and connected to the locomotive car body at a suitable location under the car body. This displacement reading will give the angle $\delta$ discussed above and shown in FIG. 1 at 3 and in FIG. 2 at 7. The reading from the sensor will be used by the microprocessor to increase the lubricant as the sharpness of the curve increases.

The output of the microprocessor is used to control the quantity of lubrication or shut off the lubrication process and turn on the sanders. The output includes: the control of lubricant flow valves 66,67 based on direction of travel of the train; turning on the sanders 45 of the locomotive in case of emergency brake application; control of lubricant application through a fluid injection pulse control 49 and/or a flow control/shut off valve 47.

The primary purpose of the microprocessor output is to control the quantity of lubricant applied to the rail. This may be accomplished by a fluid injection pulse control 49 connected via circuit 48 in which the number of fluid injections per second on the rail is computed by the microprocessor 40 based on the input parameters. An alternate approach to the control of quantity of lubricant applied is to use a flow control/shut off valve 47 in the lubricant and air flow lines 56. The output signal for this is provided through connection 46 from the microprocessor. Valve 47 has a variable-sized aperture which is controlled by the microprocessor to control the flow rate.

The direction of travel input 65 shown in FIG. 5 with the wheel 8 and rotation arrow 10, given to the microprocessor, provides an output 66,67 which will control the lubricant flow directional valves for the locomotives which are equipped with bi-directional lubrication systems. In case of emergency brake application identified through input 63, not only the lubricant application will be shut off, but also the locomotive sanders will be turned on to enable the shortest stopping distance. This can be achieved by turning on the switch used for manual sanding or turning on an indicator light which advises the locomotive engineer to turn on the sanders manually. For those locomotives where the integration of the lubrication microprocessor may be possible with the locomotive computer, this signal will be provided to the locomotive computer to switch on the controls for the sanders.

The TOR and RAGS lubricants are kept in tanks 50,51 which may be pressurized with compressed air 52,53 from the locomotive. The two lubricants are transported through separate lines to a flow control device. This can be either the fluid injection pulse control 49 or the flow control/shut off valve 47. Combinations of the two may also be possible. In case of the fluid injection pulse control, a compressed air line 57 would be necessary. The two lubricant flow lines and the compressed air are shown as three tubes 13 and 56 going to the spray assembly 14 which applies the sprays 17,18 to the rail. In certain applications where compressed air is not required, only the two lubricant flow lines will be needed. In other applications where only the TOR lubricant is applied and the railroad chooses not to apply RAGS to simplify the system, only one of the two lubricant tubes 13 will be needed. The lubricant delivery nozzles are integrated with the sand pipe 12, holding bracket 15, and nozzle 16. By this process, accurate quantities of the lubricants can be applied to the rail so that when the last car of the train has passed a certain location, no TOR lubricant is left on the rail head.

Figure 6:
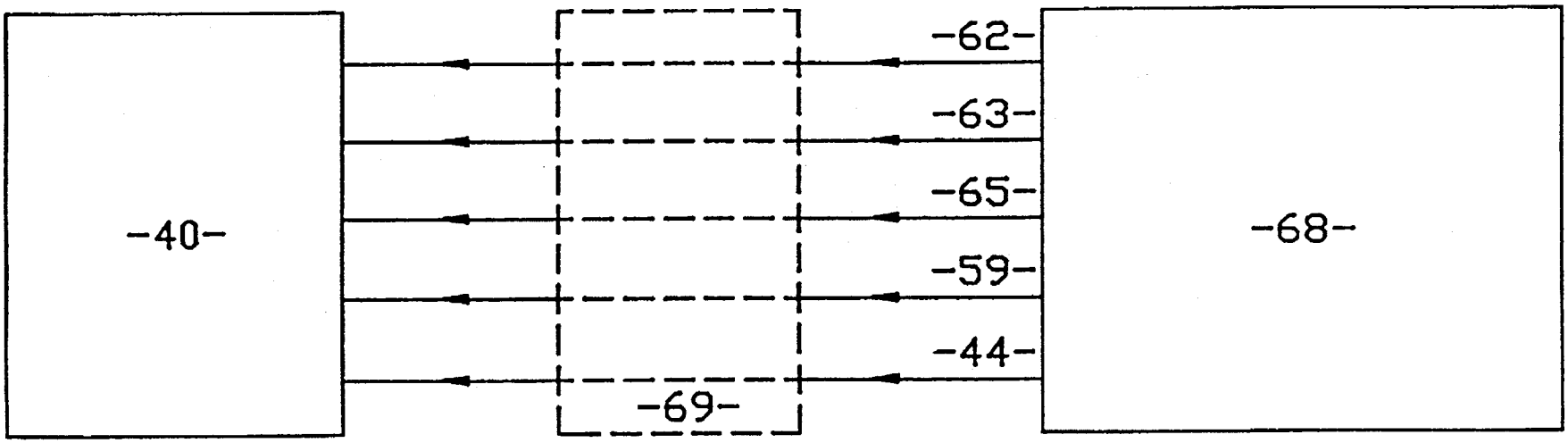
FIG. 6 shows a scheme of input of needed locomotive computer data obtained through the operations recorder.

FIG. 6 shows a scheme by which a number of inputs needed by the microprocessor 40 can be obtained from the locomotive computer 68 through the operations recorder 69. These inputs are: brake application 62, emergency brake application 63, direction of travel 65, trailing tons/power input 59, and train speed 44. As mentioned earlier, the trailing tons input may be estimated automatically by determining the average power used by the locomotives for a certain period such as 30 min, and while using a certain starting value as a default value at the time the train starts. This default value can be the average power used by an average train for the train system of a particular railroad. The power averaging technique used from the moment of starting of the train will help to converge the calculated trailing ton value to the actual trailing tons in a short time.

Figure 7:
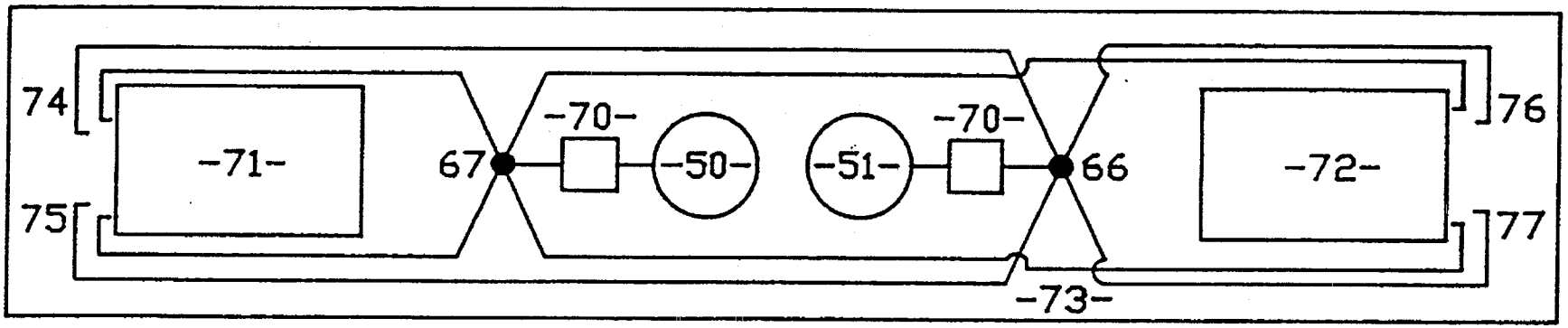
FIG. 7 is a plan view of the TOR and RAGS lubricant applications control system for bi-directional use of the locomotive.

FIG. 7 shows a schematic plan view of TOR and RAGS lubricant application and control system for a locomotive 73 in which either a front or back lubricant system can be turned on automatically depending on the direction in which the locomotive is moving. The TOR and RAGS lubricant tanks 50,51 deliver the lubricant through a line controlled by a microprocessor system 70 as shown in detail in FIG. 5. The designation 70 represents the total control system shown in FIG. 5. One microprocessor with its sensors and inputs controls the lubricant application system for both front and back systems of the locomotive. The direction of flow of the lubricants is determined by microprocessor controlled valves 66,67 so that the lubricants may be delivered to the nozzles 74,75 behind the truck 71 when the locomotive 73 is moving from left to right. When the locomotive is moving from right to left, the flow control valves 66,67 are switched by the microprocessor output to direct the lubricant flow to nozzles 76,77 behind the truck 72. Such an arrangement would enable a railroad to freely use a locomotive in either direction and take advantage of the present invention.

FIG. 8 summarizes the inputs and control logic. The inputs to the microprocessor from the sensors and the locomotive computer include train speed, the degree of rail curve, rain sensor (whether it is raining or not), temperature, braking (whether the train is in the braking mode), emergency braking, direction indicating if the locomotive is going in the forward or reverse direction, and the trailing tons/locomotive power (the input may be direct or computed based on locomotive power averaging technique). These inputs control the lubricant flow by either the fluid injection pulse control or variable flow control valve through the microprocessor. The lubricant application system is shut off when the brakes are applied, when it is raining, when the train is moving in the opposite direction, when the lubrication chambers are empty, when the manual override is initiated by the locomotive engineer, or when an unexpected contingency develops. The control system will turn on the lubrication system at the other end of the locomotive when the train is moving in the opposite direction. In the case of emergency brake application, the lubricant application will be shut off and the sand application will be initiated for quick stopping.

While a preferred form of the invention has been shown and described, it will be realized that alterations and modifications may be made thereto without departing from the scope of the following claims.

We claim:

1. In a railroad locomotive of the type having trucks each mounting wheel and axle sets and sanding systems including a pipe leading to a nozzle for applying sand to a rail adjacent the wheels, the improvement comprising an on-board lubricating device for lubricating a railroad track rail, including:

a lubricant supply tank mounted on the locomotive;

at least one lubricant supply tube in fluid communication with the lubricant supply tank, said tube being integrated with the sand pipe and terminating at a spray nozzle aimed at the rail crown at a point adjacent the point of contact between the locomotive wheel and rail; and means for controlling the flow of lubricant from the supply tank to the spray nozzle.

2. The lubricating device of claim 1 further comprising a second lubricant supply tank mounted on the locomotive and a second lubricant supply tube in fluid communication with the second lubricant supply tank, said second tube being integrated with the sand pipe and terminating at a spray nozzle aimed at the rail gage side at a point adjacent the point of contact between the locomotive wheel and rail.

3. The lubricating device of claim 1 wherein said means for controlling the flow of lubricant includes a flow control valve connected to the lubricant supply tube.

4. The lubricating device of claim 1 wherein said means for controlling the flow of lubricant includes a fluid injection pulse control connected to the lubricant supply tube.

5. The lubricating device of claim 1 wherein said means for controlling the flow of lubricant includes a means for stopping the flow of lubricant from the lubricant storage tank and triggering a signal for activating the sanding system upon application of the locomotive's emergency brakes.

6. An on-board lubricating device for lubricating a railroad track rail, the device to be mounted on the last locomotive of a locomotive consist behind the last tractive wheel, comprising a lubricant supply tank, a support bracket attached to the axle box of the locomotive's last tractive wheel, at least one lubricant supply tube in fluid communication with the lubricant supply tank and mounted on the support bracket, said tube terminating at a spray nozzle aimed at the rail crown a small distance behind the point of contact between the last tractive wheel and rail, and means for controlling the flow of lubricant from the supply tank to the spray nozzle.

7. The lubricating device of claim 6 wherein the spray nozzle is disposed so as to direct the center of the lubricant spray between two and twenty-four inches behind the last tractive wheel.

8. The lubricating device of claim 6 wherein the spray nozzle is disposed between two and twelve inches above the rail crown.

9. The lubricating device of claim 6 further comprising a second lubricant supply tank mounted on the locomotive and a second lubricant supply tube in fluid communication with the second lubricant supply tank, said second tube terminating at a spray nozzle aimed at the rail gage side a small distance behind the point of contact between the last tractive wheel and rail.

10. The lubricating device of claim 9 wherein the spray nozzle of the second supply tube is disposed so as to direct the center of the lubricant spray between two and twenty-four inches behind the last tractive wheel.

11. The lubricating device of claim 9 wherein the spray nozzle of the second supply tube is disposed between two and twelve inches above the rail crown.

12. The lubricating device of claim 6 wherein said means for controlling the flow of lubricant includes a flow control valve connected to the lubricant supply tube.

13. The lubricating device of claim 6 wherein said means for controlling the flow of lubricant includes a fluid injection pulse control connected to the lubricant supply tube.

14. The lubricating device of claim 6 wherein said means for controlling the flow of lubricant includes a means for stopping the flow of lubricant and triggering a signal for activating a locomotive sanding system upon application of the locomotive's emergency brakes.

* * * * *